United States Patent [19]

Nakazawa et al.

[11] Patent Number: 4,681,388

[45] Date of Patent: Jul. 21, 1987

[54] CORD CLAMPING MECHANISM

[75] Inventors: Akira Nakazawa; Shigeru Kikuta; Kihachiro Koike; Kensaku Matsuoka; Yoshimitsu Nishino, all of Tokyo, Japan

[73] Assignees: Hirose Elec. Co., Ltd.; NEC Corporation; Japan Aviation Elec., all of Tokyo, Japan

[21] Appl. No.: 848,315

[22] Filed: Apr. 4, 1986

[30] Foreign Application Priority Data

Apr. 4, 1985 [JP] Japan ..... 60-50183[U]

[51] Int. Cl.[4] ..... H01R 13/58

[52] U.S. Cl. ..... 439/449; 248/74.1

[58] Field of Search ..... 339/103 AU, 104, 105, 339/107; 248/74.1, 74.3, 74.5

[56] References Cited

U.S. PATENT DOCUMENTS 2,099,465 11/1937 Burleson ..... 339/103 R
2,373,833 4/1945 Johnson ..... 248/74.3
2,427,770 9/1947 Ellinwood ..... 248/74.3
3,856,245 12/1974 Byerly ..... 248/74.3
4,318,518 3/1982 Davis ..... 248/74.3

*Primary Examiner*—Eugene F. Desmond
*Attorney, Agent, or Firm*—David G. Rosenbaum

[57] ABSTRACT

A cord clamping mechanism comprises a cord clamp and a clamp mounting base for mounting the cord clamp. The cord clamp has a ring-shaped portion for passing a cord to be clamped, and a pair of legs extending from both ends of the ring-shaped portion for clamping the cord passed through the ring-shaped portion when the legs are closed. The legs are formed with openings for passing a clamping screw for closing the clamp and mounting fixedly on the base. The base is formed with a threaded opening for receiving the screw. The cord clamping mechanism further comprises a guiding projection to be inserted into the opening at a position near the ring-shaped portion between the screw and the ring-shaped portion when the clamp is mounted on the base.

3 Claims, 2 Drawing Figures

CORD CLAMPING MECHANISM

BACKGROUND OF THE INVENTION

1. Field of the Invention

This invention relates to a cord clamping mechanism and, more particularly, to an improvement in a one-side screw clamping type cord clamping mechanism.

2. Description of the Prior Art

Heretofore, as a cord clamping mechanism in a connector a one side screw clamping type as exemplified in FIG. 2 of the accompanying drawings has been employed so as to reduce the size as small as possible when the cover of the connector is small in size and the internal space is small. This conventional one-side screw clamping type cord clamping mechanism has a cord clamp 10, a clamp mounting base 20 provided inside a connector cover 1, and a clamping screw 30. The base 20 is provided near the cord leading port 2 of the cover 1, and formed with a threaded opening 21 for receiving the screw 30. The clamp 10 has a ring-shaped portion 11 for passing a cord to be clamped, and a pair of legs 12 extended from the both ends of the ring-shaped portion 11 for clamping the cord inserted into the ring-shaped portion 11 when the legs 12 are closed. Circular openings 13 for passing the screw 30 are respectively formed at the legs 12. When clamping the cord by the cord clamping mechanism of the structure thus constructed, the cord is first inserted into the ring-shaped portion 11 in the state that the clamp 10 is opened, then pulled from the cord leading port 2 of the connector cover 1, the legs 12 are placed on the base 20 so that the openings 13 of the legs 12 coincides with the threaded openings 21 of the base 20, the screw 30 is engaged with the openings 21 through the openings 13, the clamp 10 is then closed, and clamped fixedly with the base 20.

The conventional cord clamping mechanism described above can be reduced in size and can be advantageous at the point of saving the space in the connector cover, but since it is of one side screw clamping type, the conventional mechanism has such disadvantages that the clamp 10 tends to rotate as shown by an arrow A in case of clamping the screw and the sheath of the cord tends to be extended from the end 11A of the ring-shaped portion 11 to between the pair of legs 12 to be interposed between the legs 12, thereby hardly clamping the cord.

An object of this invention is to provide a cord clamping mechanism capable of eliminating the above-mentioned disadvantages of the conventional mechanism and simply performing a cord clamping work.

SUMMARY OF THE INVENTION

According to this invention, there is provided a cord clamping mechanism comprising a cord clamp, a clamp mounting base for mounting the cord clamp, the cord clamp having a ring-shaped portion for passing a cord to be clamped, and a pair of legs extending from both ends of the ring-shaped portion for clamping the cord passed through the ring-shaped portion when the legs are closed, the legs being formed with openings for passing a clamping screw for closing the clamp and mounting fixedly on the base, the base being formed with a threaded opening for receiving the screw, and a guiding projection to be inserted into the opening at a position near the ring-shaped portion between the screw and the ring-shaped portion when the clamp is mounted on the base.

This invention will now be described in further detail with regard to preferred embodiments as illustrated in the accompanying drawings.

DESCRIPTION OF THE PREFERRED EMBODIMENTS

Figure 1:
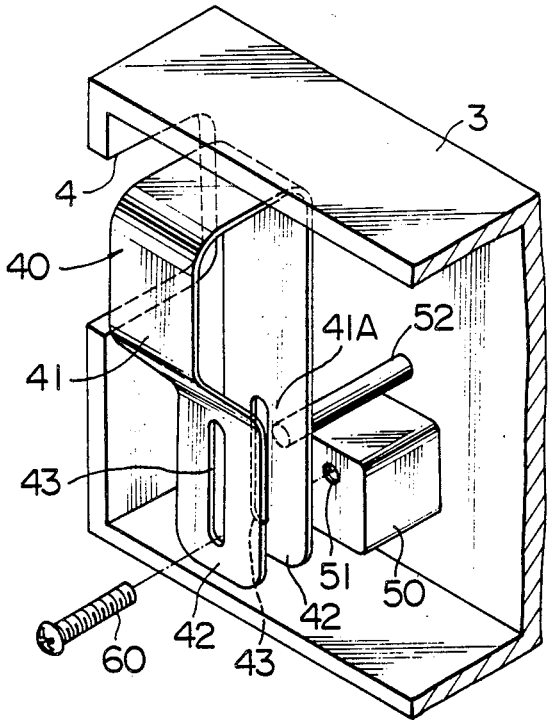
FIG. 1 is a view showing a cord clamping mechanism as an embodiment of this invention.
Figure 2:
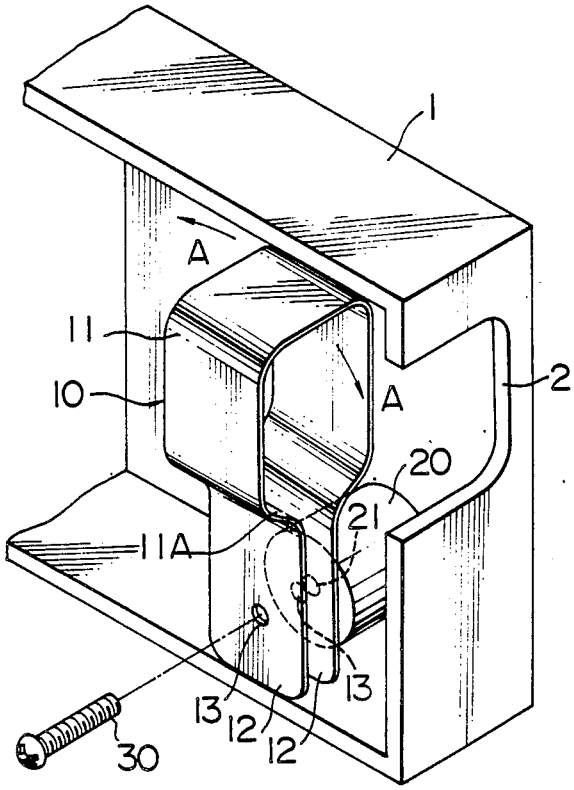
FIG. 2 PRIOR ART
FIG. 2 is a view showing an example of a conventional cord clamping mechanism.

FIG. 1 shows a cord clamping mechanism as an embodiment of this invention. The cord clamping mechanism of this embodiment comprises a cord clamp 40, a clamp mounting base 50 provided inside a connector cover 3, and a clamping screw 60. The base 50 is provided near the cord pulling port 4 of the connector cover 3, and formed with a threaded opening 51 for receiving the screw 60. The clamp 40 has a ring-shaped portion 41 for passing the cord to be clamped, and a pair of legs 42 extending from both ends of the ring-shaped portion 41 for clamping the cord passed through the ring-shaped portion 41 when the legs 42 are opened. The legs 42 are respectively formed with longitudinally long openings 43 for passing the screw 60. Further, a guiding projection 52 to be inserted into an opening 43 formed at the position near the ring-shaped portion 41 between the screw 60 and the ring-shaped portion 41 when the clamp 40 is mounted on the base 50 is projected laterally on the inner surface of the connector cover 3.

When the cord is clamped in the cord clamping mechanism of the structure thus constructed, the cord is first passed into the ring-shaped portion 41 in the state that the clamp 40 is opened, pulled from the port 4 of the cover 3, the legs 42 are placed on the base 50 so that the opening 43 of the legs 42 coincide with the threaded opening 51 of the base 50 and the projection 52 is inserted into the opening 43, the screw 50 is then engaged with the opening 51 through the opening 43, the clamp 40 is closed and clamped fixedly with the base 50.

According to the cord clamping mechanism of this invention, since the projection 52 is inserted into the opening 43 even if the screw 60 is turned when the clamp 40 is mounted fixedly on the base 50 via the screw 60, the clamp 40 may not rotate at the opening 51 as a center, and since the projection 52 is inserted into the opening 43 near the end 41A of the ring-shape portion 41, the sheath of the cord may not be extended from the end 41A of the ring-shaped portion 41 to between the pair of legs 42, nor interposed between the legs 42. Therefore, according to the cord clamping mechanism of the invention, the cord clamping work can be extremely readily performed without fail.

What is claimed is:

1. A cord clamping mechanism comprising a cord clamp, a clamp mounting base for mounting the cord clamp, said cord clamp having a ring-shaped portion for passing a cord to be clamped, and a pair of legs extending from both ends of the ring-shaped portion for clamping the cord passed through the ring-shaped portion when the legs are closed, said legs being formed with openings for passing a clamping screw for closing the clamp and mounting fixedly on the base, said base being formed with a threaded opening for receiving the screw, and a guiding projection to be inserted into the opening at a position near the ring-shaped portion between the screw and the ring-shaped portion when the clamp is mounted on said base.

2. A cord clamping mechanism as claimed in claim 1 wherein said opening is formed in a longitudinally long shape.

3. A cord clamping mechanism as claimed in claim 1 wherein said clamp mounting base is provided by the inner surface of a connector cover.

* * * * *